US009623884B2

(12) United States Patent
Brooks et al.

(10) Patent No.: US 9,623,884 B2
(45) Date of Patent: Apr. 18, 2017

(54) METHOD AND SYSTEM FOR INDEPENDENT CONTROL OF VEHICLE

(75) Inventors: James D. Brooks, Erie, PA (US); Ajith Kuttannair Kumar, Erie, PA (US); Bernardo Adrian Movsichoff, Greenville, SC (US); Ramu Chandra, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 524 days.

(21) Appl. No.: 12/774,534

(22) Filed: May 5, 2010

(65) Prior Publication Data

US 2011/0118899 A1 May 19, 2011

Related U.S. Application Data

(60) Provisional application No. 61/261,141, filed on Nov. 13, 2009.

(51) Int. Cl.
*B61L 3/18* (2006.01)
*B61L 3/00* (2006.01)
(Continued)

(52) U.S. Cl.
CPC ..... *B61L 3/006* (2013.01); *B61L 15/0072* (2013.01); *B61L 27/0027* (2013.01)

(58) Field of Classification Search
CPC .. B61L 2205/04; B61L 3/006; B61L 15/0072; B61L 15/0054; B61L 25/02;
(Continued)

(56) References Cited

U.S. PATENT DOCUMENTS 4,041,283 A * 8/1977 Mosier ..... G09B 9/04 105/61
5,720,455 A 2/1998 Klemanski et al.
(Continued)

FOREIGN PATENT DOCUMENTS

EP 0554983 A1 8/1993
WO WO9960735 A1 11/1999
(Continued)

OTHER PUBLICATIONS

Search Report and Written Opinion from corresponding PCT Application No. PCT/US2010/054730 dated Jun. 20, 2011.

*Primary Examiner* — Ryan Zeender
*Assistant Examiner* — Milena Racic
(74) *Attorney, Agent, or Firm* — John A. Kramer; Global Patent Operation

(57) ABSTRACT

Methods and systems are provided for controlling movement of a train including a plurality of locomotives along a route. In one example, the method comprises, generating a first plan profile, the first plan profile including synchronous settings for the locomotives over a route, and generating a second plan profile based on the first plan profile, the second plan profile including independent settings for the locomotives over at least one region within the route. The method may further comprise, operating the locomotives based in the first and/or second plan profiles. In another example, the method comprises, generating a plan profile with fully independent settings for the locomotives over the entire route, the fully independent settings based on cost function coefficients of each locomotive.

12 Claims, 8 Drawing Sheets

(51) Int. Cl.
*B61L 15/00* (2006.01)
*B61L 27/00* (2006.01)

(58) Field of Classification Search
CPC ..... B61C 17/12; B61C 3/00; B60T 2201/04; B60T 13/665; B60T 17/228
USPC ..... 701/2, 19, 20, 1, 123, 70
See application file for complete search history.

(56) References Cited

U.S. PATENT DOCUMENTS 5,738,311 A 4/1998 Fernandez
5,740,547 A 4/1998 Kull et al.
5,785,392 A 7/1998 Hart
5,813,635 A 9/1998 Fernandez
5,820,226 A 10/1998 Hart
5,833,325 A 11/1998 Hart
5,927,822 A 7/1999 Hart
5,934,764 A 8/1999 Dimsa et al.
5,950,967 A 9/1999 Montgomery
5,969,643 A * 10/1999 Curtis ..... B61L 3/004 340/933
5,978,718 A 11/1999 Kull
5,986,577 A 11/1999 Bezos
5,986,579 A 11/1999 Halvorson
5,995,881 A 11/1999 Kull
6,114,974 A 9/2000 Halvorson
6,128,558 A 10/2000 Kernwein
6,163,089 A 12/2000 Kull
6,216,095 B1 4/2001 Glista
6,275,165 B1 8/2001 Bezos
6,322,025 B1 11/2001 Colbert et al.
6,353,780 B1 * 3/2002 Hart ..... B60L 15/2009 246/182 A
6,360,998 B1 3/2002 Halvorson et al.
6,377,215 B1 4/2002 Halvorson et al.
6,691,957 B2 2/2004 Hess, Jr. et al.
6,782,044 B1 8/2004 Wright et al.
6,799,096 B1 9/2004 Franke et al.
6,981,419 B1 * 1/2006 Hay ..... G01N 29/226 73/636
7,073,753 B2 * 7/2006 Root ..... B60T 13/662 246/72
7,416,262 B2 8/2008 Ring
7,859,424 B2 * 12/2010 Severson ..... A63H 19/14 104/296
8,154,227 B1 * 4/2012 Young ..... A63H 19/24 318/255
8,157,218 B2 4/2012 Riley et al.
8,428,798 B2 4/2013 Kull
8,473,127 B2 * 6/2013 Daum ..... B61L 3/006 701/19
2004/0044447 A1 * 3/2004 Smith ..... 701/19
2004/0172175 A1 * 9/2004 Julich et al. ..... 701/19
2004/0245410 A1 12/2004 Kisak et al.
2005/0121971 A1 6/2005 Ring
2007/0219680 A1 9/2007 Kumar et al.
2007/0219682 A1 9/2007 Kumar et al.
2008/0269967 A1 * 10/2008 Kumar et al. ..... 701/19
2009/0299555 A1 * 12/2009 Houpt et al. ..... 701/19
2010/0019103 A1 * 1/2010 Kane ..... B61C 17/12 246/186

FOREIGN PATENT DOCUMENTS

WO 0108958 A1 2/2001
WO 2010011484 A1 1/2010
WO WO2010039680 A1 4/2010
ZA 200101708 A 8/2001

* cited by examiner

METHOD AND SYSTEM FOR INDEPENDENT CONTROL OF VEHICLE

CROSS REFERENCE TO RELATED APPLICATIONS

This application claims the benefit of U.S. Provisional Patent Application No. 61/261,141, filed Nov. 13, 2009, the entirety of which is hereby incorporated by reference for all purposes.

FIELD

The subject matter disclosed herein relates to a method and system for independently adjusting settings on one or more locomotives of a train consist to improve overall performance.

BACKGROUND

Train consists may be configured with one or more locomotives and one or more cars. The locomotives may include a leading master locomotive and one or more trailing slave locomotives. A train controller may adjust the distribution of power between the various locomotives, based on vehicle operating conditions and/or operating commands, to improve vehicle performance.

Distributed power systems may be operated in a synchronous mode wherein the operation of the slave locomotives (herein also referred to as remote consists) may be synchronized to match the operation of the master locomotive (herein also referred to as lead consist), for example using common notch settings. Alternatively, distributed power systems may be operated in a fully independent mode wherein the operation of each locomotive is adjusted independently and additional degrees of freedom are allowed. As such, due to the inclusion of multiple factors and constraints, optimization routines that determine locomotive settings for an independent trip plan may be more complex than routines that determine settings for synchronous trip plans. Furthermore, multiple solutions may be computed for independent trip plans, and the selection of a final plan may require additional inputs, such as an operator input.

Optimization routines may be used to determine locomotive settings for a synchronous trip plan or an independent trip plan based on vehicle operating conditions, the selected mode of distributed power control, and operator inputs (such as operator preferences). However, there may be segments of a synchronous trip plan wherein further performance improvements may be obtained by using independent distributed power control. Similarly, there may be segments of an independent trip plan that may benefit from synchronous distributed power control.

BRIEF DESCRIPTION OF THE INVENTION

Methods and systems are provided for planning operations of a train including a plurality of locomotives. In one embodiment, the method comprises, generating a first plan profile, the first plan profile including synchronous settings for the locomotives over a route. The method further comprises, generating a second plan profile based on the first plan profile, the second plan profile including independent settings for the locomotives over at least one region within the route. The locomotives may then be operated based on the first and/or second plan profiles to thereby move the train along the route.

In another embodiment, the method comprises, generating a (third) plan profile including only independent settings over the entire trip. Further, the independent settings may be updated with real-time adjustments based on vehicle operating conditions and predefined constraints and limits.

In one example, before a train with a plurality of locomotives is dispatched, a controller may be configured to generate a first plan profile for the journey, based on vehicle operating conditions (for example, current, estimated and predicted operating conditions), track conditions, operator inputs, etc. The first plan profile may include synchronous settings for the locomotives over the route, including a common throttle notch setting and brake settings. Then, the first plan profile may be re-processed in view of predefined limits and thresholds, based on a combination of operational factors, to automatically determine at least one region within the route, based on the first plan profile and further based on a track database, that may be replaced with settings from a second plan profile. The controller may then generate a second plan profile, based on the first plan profile including independent settings for the locomotives over the automatically identified at least one region within the route. The independent settings may include two or more notch settings, and/or multiple brake settings. Generating the second plan profile may include, determining a window for the automatically identified region, and operating the second plan profile in the window. The size of the window may be based on the first plan profile and/or a track database (e.g., terrain details). In one embodiment, the first and/or second plan profiles may be used to control operations of the train along a route. In another embodiment, the first and/or second profiles may be used to control movement of the train and locomotives along the route.

For example, the first plan profile may be used to calculate predicted coupler force levels. The coupler forces may be estimated simply via a lumped-mass rope model or in a more complex fashion taking coupler dynamics into account. The first plan profile may then be re-evaluated to identify regions with a large number of nodes (that is, regions with potential for high coupler force transients), a prolonged duration with high range coupler forces, or regions that traverse terrain features known to benefit from independent operation, such as crests, sags, and undulations. Following identification of such regions, windows may be created to define the region wherein the synchronous settings may be replaced with independent settings to improve vehicle performance.

A final trip plan for the train may, consequently, include synchronous portions with synchronous settings from the first plan profile and independent portions with independent settings from the second plan profile. The train may then be dispatched according to the final trip plan. Following dispatch, the operating conditions of the train may be continuously monitored. Real-time adjustments may then be made to the final trip plan based on variations in the monitored operating conditions from expected settings or predetermined thresholds.

In this way, performance benefits of both synchronous modes and independent modes of distributed power control may be attained without substantially increasing the complexity and amount of time required for generating a train plan profile. By generating a first synchronous plan profile, and then reprocessing the first plan profile to identify segments therein that may be updated with a second independent plan profile, the performance and efficiency of the various locomotives of a train may be substantially improved.

In another example, before the train is dispatched, a fully independent travel plan may be requested. In response to the fully independent plan request, the engine controller may generate a (third) fully independent plan profile for the journey, based on vehicle operating conditions, various operator input cost functions and constraints, etc., including independent settings for the locomotives over the entire route. Herein, the cost functions may include, for example, power, tractive effort, coupler forces, nodes, rate of change of tractive effort, rate of change of coupler forces, node motion, fuel usage, etc. As such, each cost function may be defined by distinct cost function coefficients. Additionally, each locomotive in the locomotive consist may be ascribed a distinct set of cost function coefficients. Similarly, each locomotive may be ascribed a distinct set of constraints and rules related to various operating parameters.

For example, a first consist may be ascribed a first set of cost function coefficients based on the position of the consist, the age of the consist, the composition of the consist etc. A second consist may be ascribed higher coefficients and/or may be more constrained due to a higher age (e.g., the consist may have been operated on more than a threshold number of missions), and consequently a higher degree of wear and tear. For example, in the second, older, consist, a lower threshold of node motion may be applied, a lower threshold for coupler forces may be applied, and/or a lower limit for tensile and compressive forces may be applied. The fully independent plan may also be updated in real-time based on the prevalent vehicle operating conditions. Similar limits and constraints may be applied to the locomotive consists during the real-time updates as during the fully independent plan profile generation. Alternatively, additional limits and constraints may be imposed during the real-time updates.

In one example, the fully independent plan profile may be requested when a higher degree of optimization is required. In another example, the fully independent plan profile may be selected based on the first synchronous plan profile and/or the second independent plan profile previously generated. For example, if more than a threshold number of segments of the second independent plan profile include independent settings, the controller may generate and operate the train with the fully independent plan profile. In another example, the first synchronous plan profile is used as an initial solution for lead and remote fully independent settings of the fully independent plan profile. In this way, performance benefits of synchronous and independent modes of distributed power control may be attained, as desired.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The present invention will be better understood from reading the following description of non-limiting embodiments, with reference to the attached drawings, wherein below.

DETAILED DESCRIPTION

Figure 1:
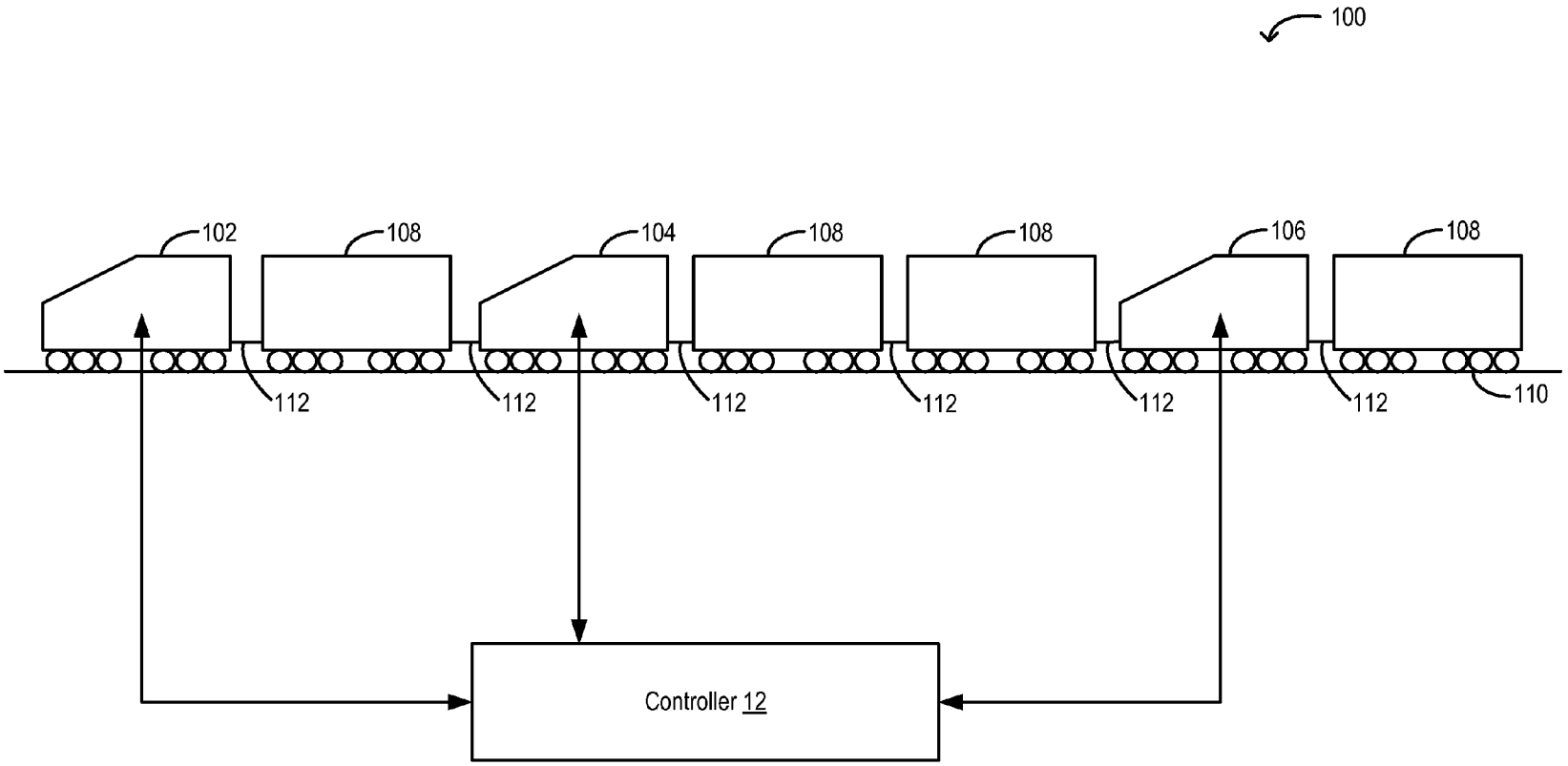
FIG. 1 shows an example embodiment of a train with multiple locomotives and cars.
Figure 2:
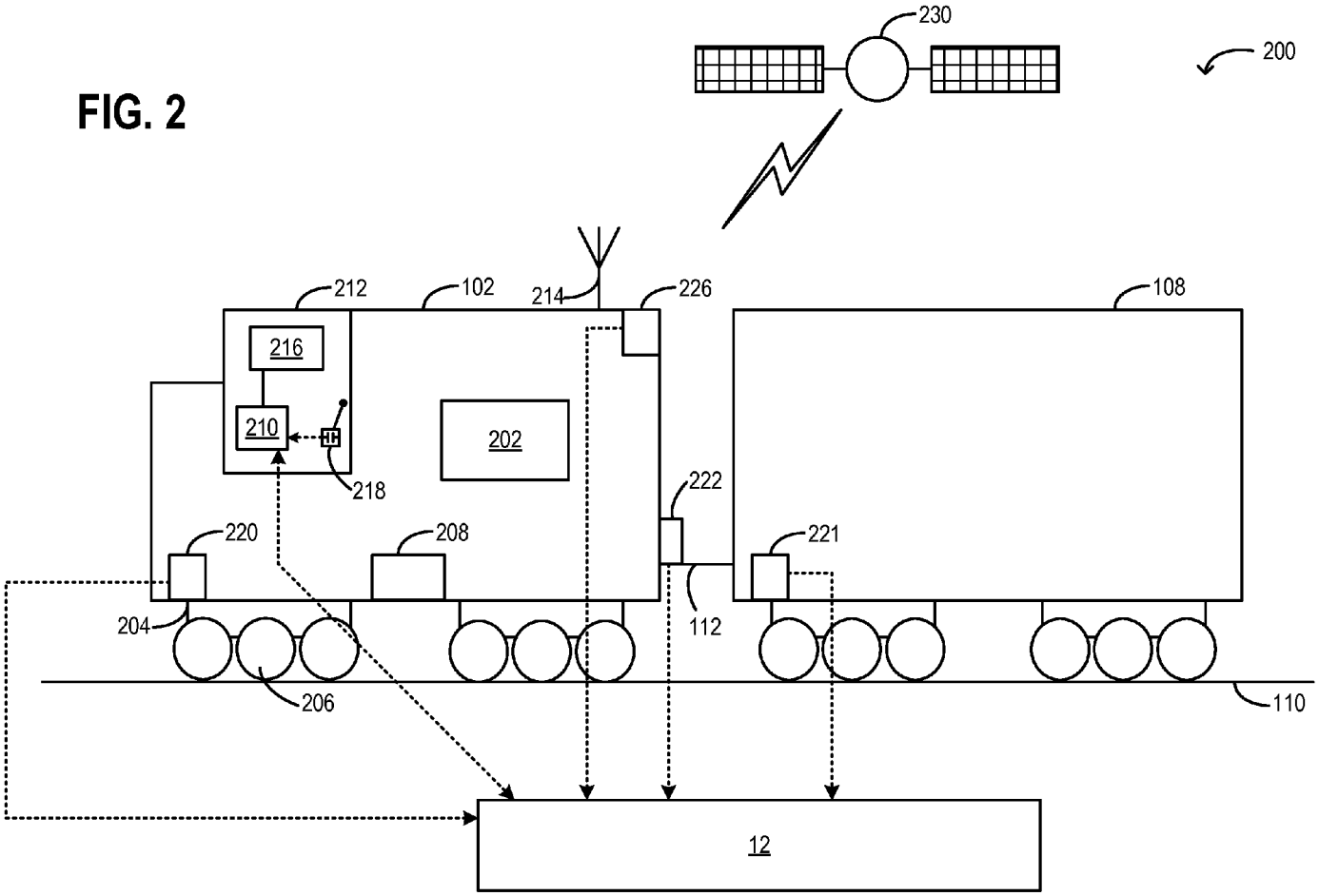
FIG. 2 shows an example embodiment of a lead locomotive and a trailing car.
Figure 3:
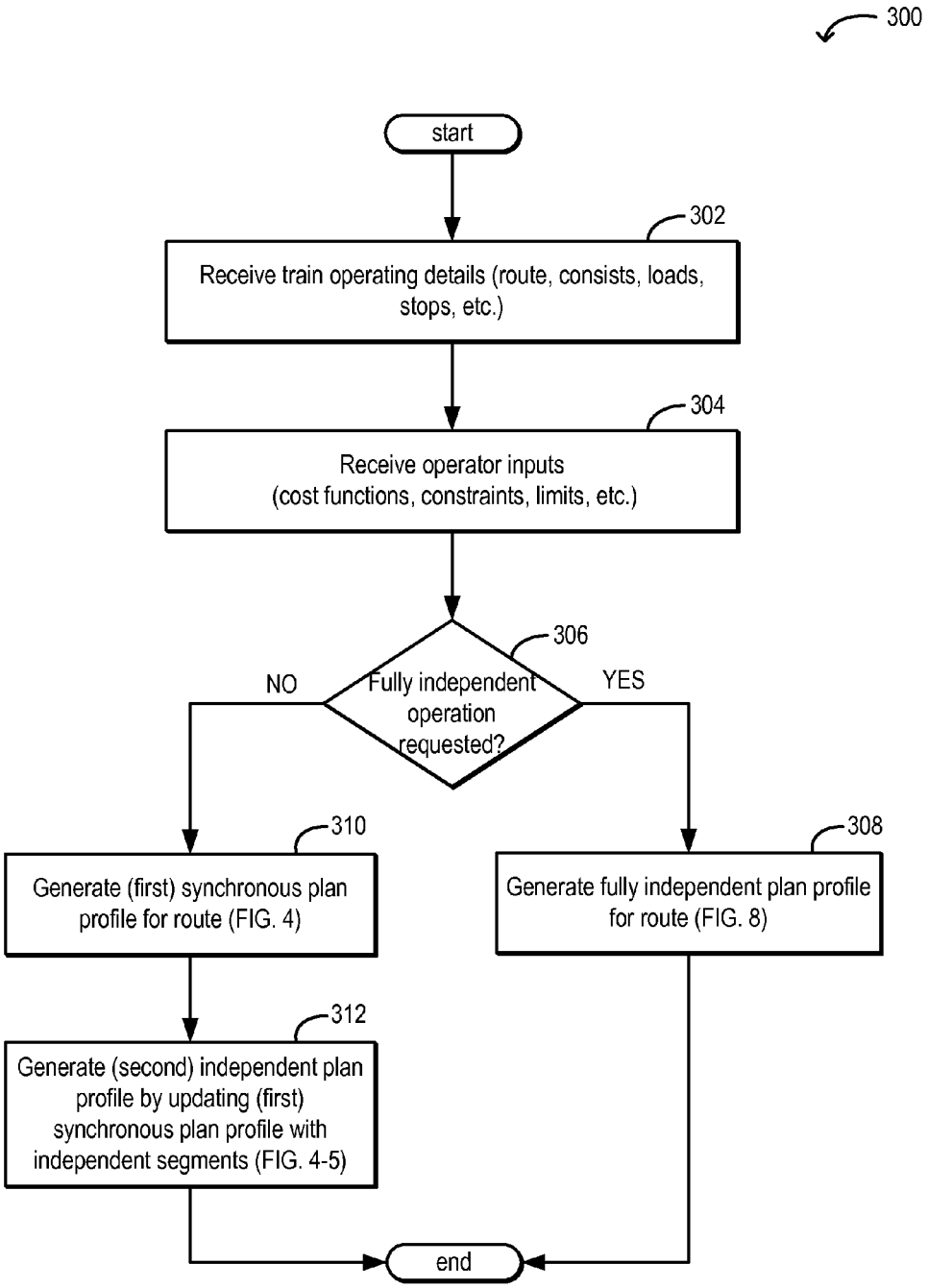
FIG. 3 shows a high level flow chart for selecting a plan profile for a train.
Figure 7:
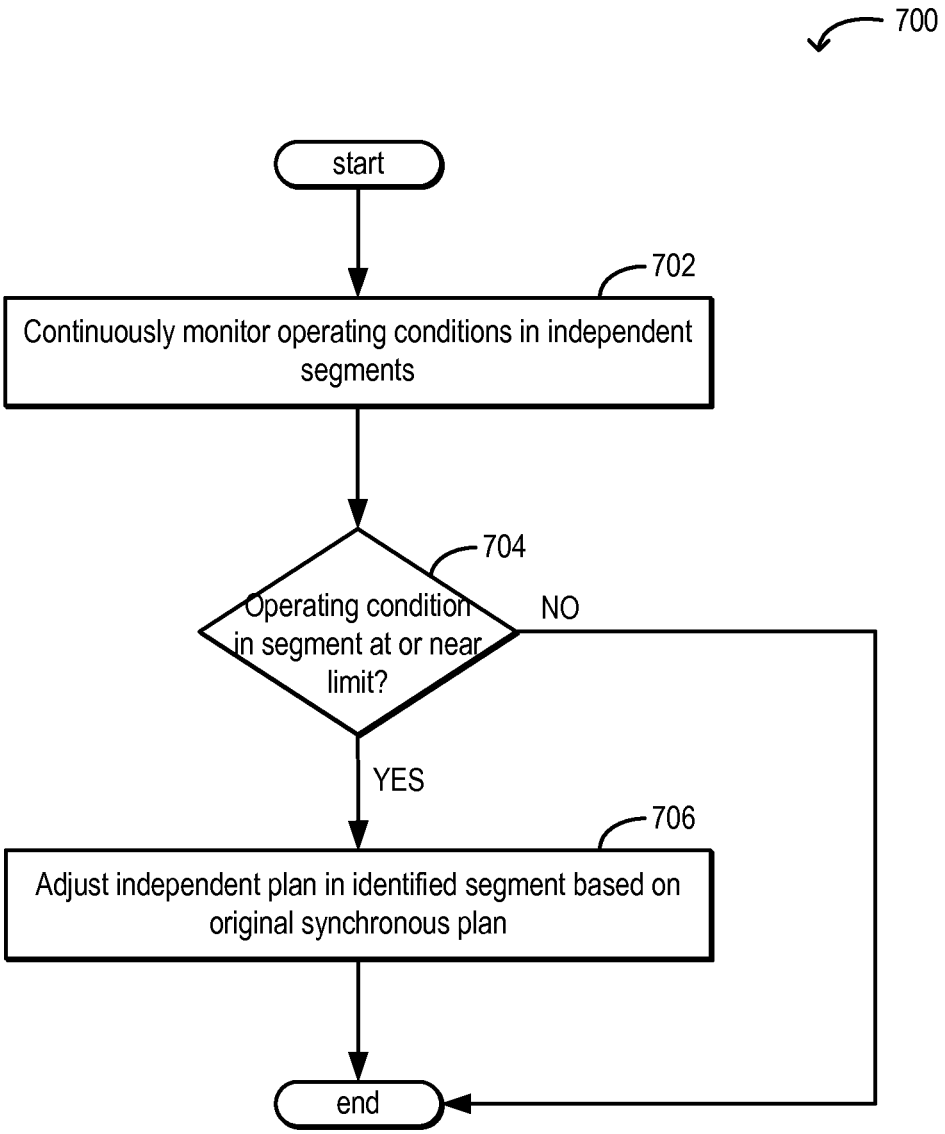
FIG. 7 shows a high level flow chart for performing real-time updates to the independent trip segments of FIG. 6.
Figure 8:
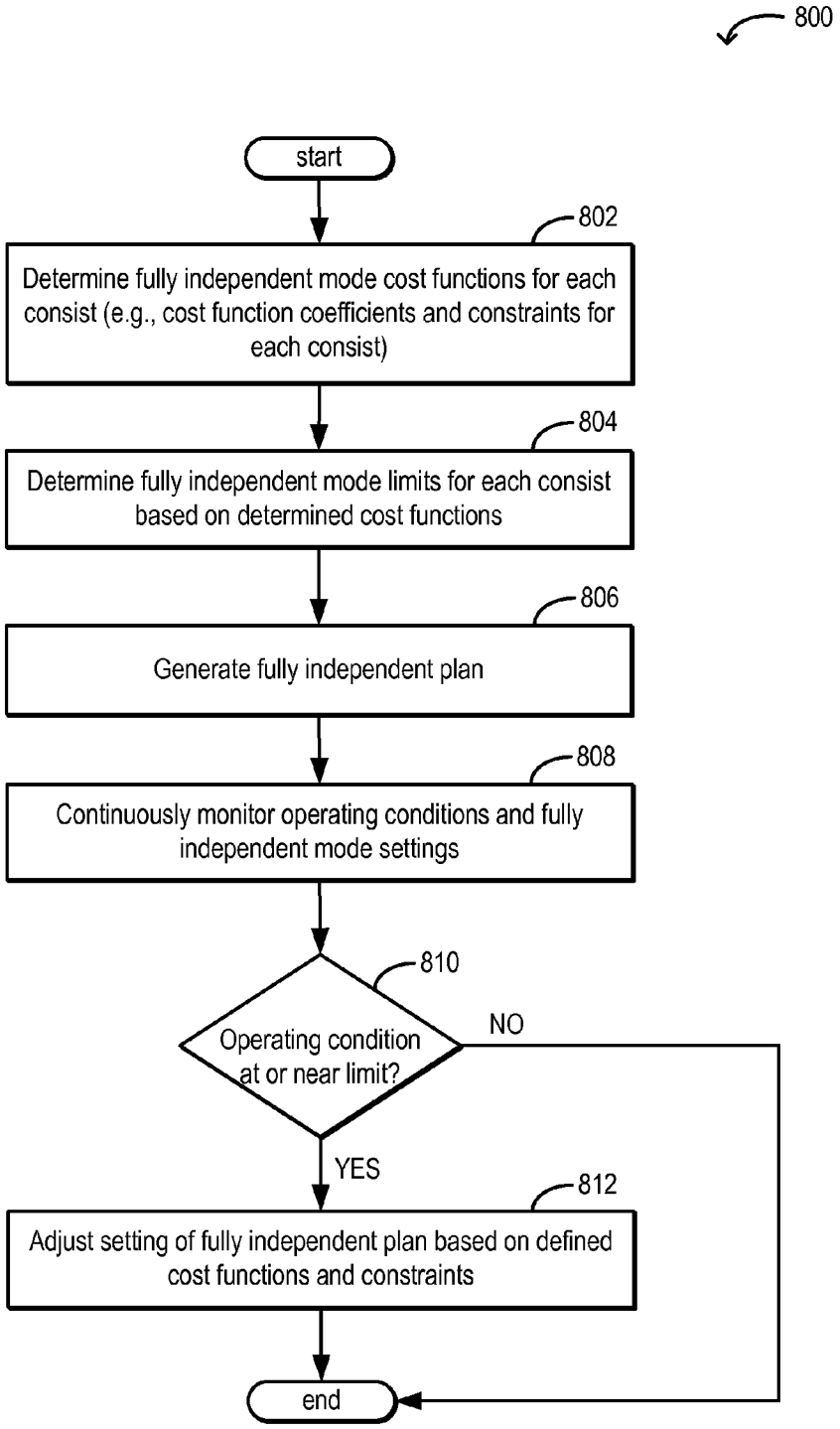
FIG. 8 shows a high level flow chart for operating a train with a fully independent plan profile.

Trains with multiple locomotives (as shown in FIGS. 1-2) may be operated with distributed power control wherein power distribution between different locomotives is adjusted based on operating conditions and/or operator inputs. As shown in FIG. 3, a train controller may be configured to operate the train with a fully independent plan profile with only independent settings over the entire route in response to a request for a fully independent plan. Accordingly, a fully independent plan profile may be generated based on inputs received from an operator regarding consist-specific cost functions, constraints, etc., as illustrated in FIG. 8. Following implementation of the fully independent plan profile, the operating conditions of the train may be constantly monitored, and independent settings may be updated in real-time, if an opportunity arises, as illustrated in FIG. 7.

Figure 4:
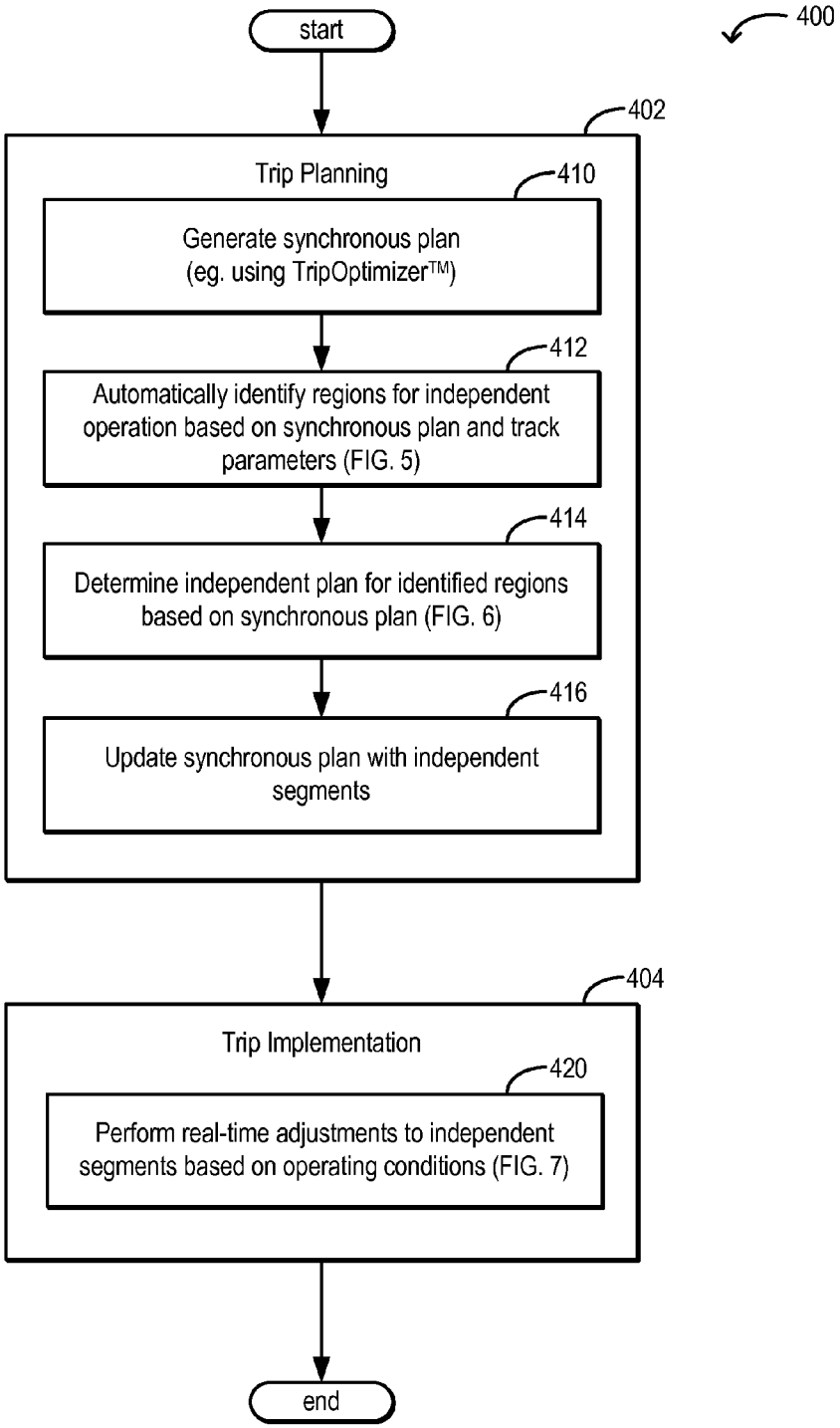
FIG. 4 shows a high level flow chart for operating a train with a synchronous plan profile updated with independent segments, according to the present disclosure.
Figure 5:
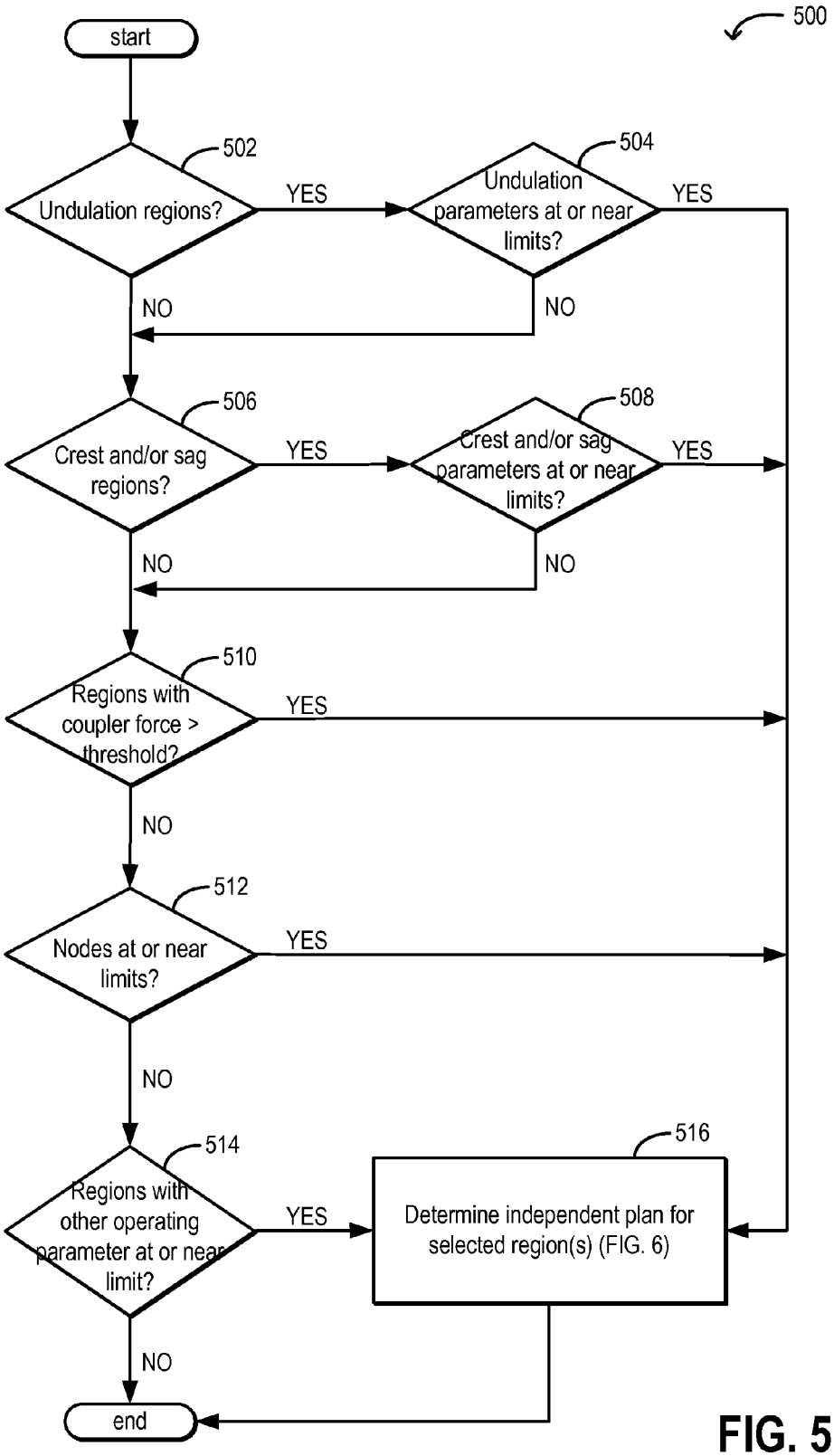
FIG. 5 shows a high level flow chart for identifying regions of a synchronous plan profile that may be updated with independent segments.
Figure 6:
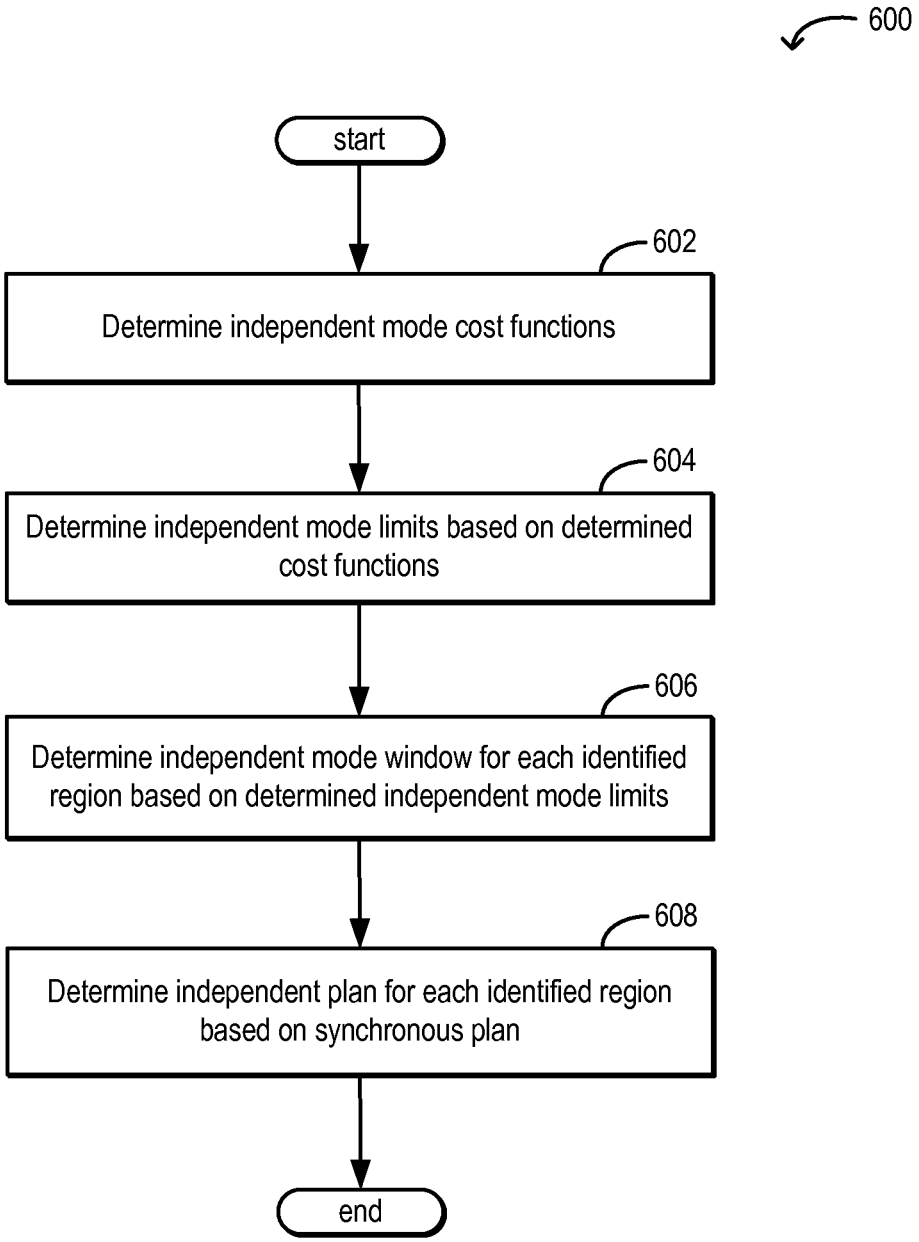
FIG. 6 shows a high level flow chart for determining an independent plan profile for the synchronous plan regions previously identified in FIG. 4.

Alternatively, as shown in FIG. 4, the train controller or other processing system may be configured to generate a first synchronous plan profile wherein train operations are optimized using a default synchronous mode of distributed power control, for example as illustrated in FIG. 4. The synchronous plan profile may then be automatically evaluated for regions wherein operational benefits may be achieved using an independent mode of distributed power control, for example as illustrated in FIG. 5. By assigning limits and cost functions when operating in the independent mode, the first synchronous plan profile for the identified regions may be updated to generate the second plan profile including independent settings from an independent plan profile, for example as illustrated in FIG. 6. Following implementation of the final plan profile, the operating conditions of the train may be constantly monitored, for example in the independent segments. In the event that the monitored operating conditions in the independent segments become limited or deviate from expected values, the independent settings of those segments may be updated in real-time, as illustrated in FIG. 7.

In this way, synchronous mode and independent mode benefits may be attained. For example, by using a synchronous plan profile as a default profile for optimizing train operations, and updating regions of the synchronous plan profile with independent plan profile settings, vehicle performance may be improved without adding substantial complexity to the operations. Further, by performing independent updates automatically, operator/driver input requirements may also be reduced, thereby reducing the possibility of errors. Alternatively, when multiple constraints and factors are included, by using an independent plan profile for the route, a higher degree of optimization may be obtained and train performance benefits may be achieved.

FIG. 1 depicts an example train 100, including a plurality of locomotives 102, 104, 106 and a plurality of cars 108, configured to run on track 110. The plurality of locomotives 102, 104, 106 may include a master locomotive 102 (herein also referred to as a lead locomotive) and one or more slave locomotives 104, 106 (herein also referred to as trail or remote locomotives). While the depicted example shows three locomotives and four cars, any appropriate number of locomotives and cars may be included in train 100.

Locomotives 102, 104, 106 may be powered for propulsion, while cars 108 may be non-powered. In one example, locomotives 102, 104, 106 may be diesel-electric locomotives powered by diesel engines. However, in alternate embodiments, the locomotive may be powered with an alternate engine configuration, such as a gasoline engine, a biodiesel engine, a natural gas engine, or wayside (e.g., catenary, or third-rail) electric, for example.

Locomotives 102, 104, 106 and cars 108 may be coupled to each other through couplers 112. While the depicted example illustrates locomotives 102, 104, 106 connected to each other through interspersed cars 108, in alternate embodiments, the one or more locomotives may be connected in succession, as a consist, while the one or more cars may be coupled to a remote locomotive (that is, locomotive not in the lead consist) in succession. When operating with distributed power, as depicted herein, train 100 may include a lead locomotive 102, or lead consist, and one or more remote locomotives, or remote consists.

A train controller 12 may be configured to receive information from, and transmit signals to, each of the locomotives of train 100. As further elaborated with reference to FIG. 2, controller 12 may receive signals from a variety of sensors on train 100 regarding train and/or individual locomotive operating conditions, and may adjust train operations accordingly. For example, controller 12 may adjust the distribution of power between the locomotives of train 100 based on overall train and/or individual locomotive operating conditions. In one example, controller 12 may be in a remote location, such as at a dispatch center. In another example, controller 12 may be in a local environment, such as on-board the master locomotive.

FIG. 2 depicts an example embodiment 200 of a lead locomotive 102 and one trailing car 108. In alternate embodiments, lead locomotive 102 may be a lead consist coupled to one or more trailing cars. Locomotive engine 202 generates a torque that is used by a system alternator (not shown) to generate electricity for subsequent propagation of lead locomotive 102. Traction motors (not shown), mounted on a truck 204 below the locomotive, provide tractive power for propulsion. In one example, as depicted herein, six inverter-traction motor pairs may be provided for each of six axle-wheel pairs 206 of locomotive 102. The traction motors may also be configured to act as generators providing dynamic braking to brake locomotive 102. In particular, during dynamic braking, each traction motor may provide torque in a direction that is opposite from the torque required to propel the locomotive in the rolling direction thereby generating electricity. At least a portion of the generated electrical power may be routed to a system electrical energy storage device, such as a battery (not shown). Air brakes 208 making use of compressed air may also be used by locomotive 102 for braking Locomotive operating crew and electronic components involved in locomotive systems control and management, such as an on-board diagnostics (OBD) system 210, may be housed within locomotive cab 212. OBD system 210 may be in communication with controller 12, for example through wireless communication 214. Operating crew may input instructions, preferences, predefined operational limits, over-riding details, etc. specific to planning a trip and generating a plan profile while on-board via OBD system 210 and connected display 216. Similarly, trip details generated by controller 12, for example as based on a final plan profile, may be displayed to the operating crew via display 216. As elaborated herein, one or more of OBD system 210 and locomotive controller 12 may include computer readable storage medium with code therein, the code carrying instructions for generating a first plan profile for the locomotives over the route, automatically identifying one or more regions within the route based on the first plan profile, and generating a second plan profile for the locomotives over the indentified regions within the route.

Referring to FIGS. 1 and 2, a vehicle operator may control the operation of train 100 by communicating operational bounds, limits, and preferences corresponding to different plan profiles, with OBD system 210 and/or locomotive controller 12. For example, a vehicle operator may control the power output of all the locomotives 102, 104, 106 of the train (thereby also controlling locomotive speed) by adjusting locomotive throttle and/or brake settings. As such, each locomotive 102, 104, 106 in the train consist 100 may be configured with a stepped or "notched" throttle (not shown) with multiple throttle positions or "notches". In one example, the throttle may have nine distinct positions, including one idle notch corresponding to an idle engine operation and eight power notches corresponding to powered engine operation, and continuous dynamic braking notches from setup to brake 8. Additionally, an emergency air brake application corresponding to an emergency stop position may also be included. When in the idle notch position, locomotive engine 202 may receive a minimal amount of fuel enabling it to idle at low at RPM. Additionally, the traction motors may not be energized. That is, the locomotive may be in a "neutral" state. To commence operation of the locomotive, the operator may select a direction of travel by adjusting the position of reverser 218. As such, reverser 218 may be placed in a forward, reverse, or neutral position. Upon placing the reverser in either a forward or reverse direction, the operator may release brake 208 and move the throttle to the first power notch to energize the traction motors. As the throttle is moved to higher power notches, the fuel rate to the engine is increased, resulting in a corresponding increase in the power output and locomotive speed.

Returning to FIG. 2, locomotive 102 may include various sensors for determining locomotive operating conditions and communicating the same with OBD system 210 and/or controller 12. The various sensors may include track sensor 220 configured to provide information regarding track 110. The information may include track grade, elevation, curvature, topography, speed limits, etc. Track information may be stored in a track database in controller 12. The track database may be used by controller 12 to estimate current and/or future positions of the locomotive consist. Coupler force sensor 222 may be configured to measure a force transmitted through coupler 112. As such, a tractive effort (TE) being hauled by locomotive 102 may also be inferred from the output of coupler force sensor 222. Location sensor 226 may determine a location of the locomotive, locomotive consist, or train. In one example, location sensor 226 may be a GPS sensor, communicating with satellite 230 through wireless communication 214. In alternate embodiments, location sensor 226 may include radio frequency automatic equipment identification (RF-AEI) tags, dispatch and/or video determination. In still another embodiment, the location of a locomotive may be determined based on the distance traveled from a reference point, for example, as estimated by a system tachometer. Information about travel locations may alternately be transferred from other trains. Wireless communication 214 may also be used to communicate between trains and/or with a remote location, such as a dispatch center. Further still, wireless communication 214 may be used to communicate between the different locomotives of train 100.

Now turning to FIG. 3, an example routine 300 is depicted for selecting a plan profile for a train including a plurality of locomotives. Specifically, the routine may determine whether to operate the locomotives in an independent mode with independent settings over the entire trip route or operate the locomotive in a synchronous mode with synchronous settings and independent mode updates. As such, in the independent mode, different locomotives, or groups of locomotives, or consists, in the train may be operated with different settings of notch, braking, etc. As elaborated herein, the settings for the different locomotives may be adjusted based on predefined locomotive-specific and/or independent-mode specific cost functions, constraints, and limits. In comparison, in the synchronous mode, the different locomotives may be operated with synchronous settings. In one example, the routine of FIG. 3 may be performed by an off-board controller located at a remote location, such as a dispatch center, before the dispatch of the train. In another example, the routine of FIG. 3 may be performed by an on-board locomotive controller prior to dispatch. For example, the plan profiles may be generated by the on-board controller in segments as the trip progresses.

At 302, the routine may include receiving train operating details including, but not limited to, train configuration (e.g., number and location of locomotive consists), locomotive loads, planned travel route, number of routes, etc. At 304, operator inputs may be received such as, for example, cost functions and constraints for the different locomotive consists, additional limits and constraints that may be imposed based on the planned travel route, the destination, the stops, etc. In one example, the constraints and limits may be stored in a look-up table and accessed based on the train operating details received at 302. For example, the locomotive specific cost functions may be received at 304 based on the train configuration received at 302. Additionally or optionally, cost functions and limits may be directly input to a controller by an operator.

At 306, it may be confirmed whether a full independent operation of the train over the entire route is requested. In one example, the full independent operation may be requested when a higher degree of optimization is required. As such, while an independent plan profile with independent settings over the entire route may allow a higher degree of optimization of settings over the route, the higher complexity involved in generation of the independent plan profile may also entail a longer time and more processing to generate the plan profile. Thus, in one example, when a higher degree of optimization is required (for example, due to a larger number of constraints) and a time constraint for generating the profile is lower, a full independent operation of the train may be performed. If requested, then at 308, the controller may proceed to generate an independent plan profile with independent settings for the train over the entire route. Details of independent plan generation are elaborated herein with reference to FIG. 8. In comparison, if a fully independent operation is not requested (for example, due to time and monetary constraints), at 310, the controller may proceed to generate a synchronous plan profile for the route. At 312, the controller may automatically analyze the synchronous plan profile and update segments of the synchronous plan profile with independent settings. Details of synchronous plan generation and independent segment updates are elaborated herein with reference to FIGS. 3-4.

Now turning to FIG. 4, an example routine 400 is depicted for planning operations of a train including a plurality of locomotives. Specifically, the routine may generate a first synchronous plan profile with synchronous settings for operating a train in a synchronous mode, and then update selected regions of the synchronous plan profile with independent settings from a second independent plan profile to operate the train in an independent mode. As such, under synchronous control, the lead and all remote locomotive in the train may be operated the same, such that when a control command is initiated at the lead locomotive, the same command may be sent to, and executed at, each remote locomotive. For example, when a synchronous notch setting is commanded to the lead locomotive, the same notch setting may be executed by each of the remote locomotives. In another example, when a synchronous brake setting is commanded to the lead locomotive, the same brake setting may be executed by each of the remote locomotives. In comparison, under independent control, different locomotives, or groups of locomotives, or consists, in a train may be operated differently. For example, a first notch setting may be commanded to the lead locomotive while a second, different, notch setting may be commanded to one or more remote locomotives.

Routine 400 includes trip planning 402 and trip plan implementation 404. Trip planning 402 may be performed by a controller, for example, before the dispatch of the train. Following train dispatch, a controller may monitor train conditions to enable trip plan implementation 404. Trip planning 402 may include, at 410, generating a first synchronous plan profile (herein also referred to as a synchronous plan) based on estimated vehicle operating parameters, operator indicated preferences, and selected cost functions (e.g., fuel usage, time, etc.). In one example, a synchronous plan may be generated using trip optimization software, such as TripOptimizer™. For example, some aspects of the present invention may utilize, or be implemented using, certain of the concepts set forth in U.S. Publication No. 20070219680A1, dated Sep. 20, 2007, which is hereby incorporated by reference in its entirety.

The synchronous plan may be generated based a variety of vehicle operating parameters. The plan may enable the train's operations for the duration of the mission to be adjusted to improve certain operating criteria parameter requirements while satisfying schedule and/or speed constraints. In one example, a synchronous plan may be computed to satisfy a fuel efficiency requirement. In another example, the synchronous plan may be computed to satisfy an emissions level requirement. In still other example, the synchronous plan may be computed to satisfy more than one operating criteria parameter requirement based on weightings assigned to each parameter (for example, by assigning a higher weightage to fuel efficiency and a lower weightage to schedule). Further still, the plan may be computed in view of predefined penalties. For example, excessive throttle variation may be penalized.

To generate the synchronous plan, a controller may first determine vehicle operating conditions at the time of vehicle dispatch, and anticipated vehicle operating conditions over the duration of the mission. The conditions may be measured, estimated and/or inferred, for example, from various sensors on the train or locomotive (as previously elaborated in FIG. 2), track databases, train journey databases (for example, of the same train or of different trains travelling the same route), global positioning systems, individual locomotive databases, fleet databases, weather databases, infrastructure databases, etc. The information input into trip optimization software may include, for example, train position, consist description (e.g., locomotive models, age, length, tonnage, horsepower, etc), car makeup (number of cars, type of cargo, tonnage, etc.), train marshaling, effective drag coefficients, desired trip parameters (e.g., desired speed range, desired start time and location, desired end time and location, desired travel time, desired number and location of stops, crew identification, crew shift expiration times, desired route, etc.), locomotive power description, performance history of locomotive traction transmission, engine fuel consumption as a function of output power, cooling characteristics, intended trip route, terrain characteristics of trip route, effective track grade and curvature as a function of milepost (or an effective grade), etc.

For example, coupler force levels may be estimated and/or predicted in the synchronous plan profile. In one example, coupler forces may be estimated using a simplified force model, such as a lumped-mass rope model. In another example, coupler forces may be estimated using a complex force model taking coupled dynamics into account, and/or based on input from coupler force sensors. As elaborated below, points where the coupler force transitions, for example, changes from stretched to bunched, herein also referred to as nodes, may be particularly significant.

Based on the data input into the controller, the first synchronous plan profile may be generated. The profile may contain speed and power (or notch) settings for the train to follow during the upcoming journey expressed as a function of, for example, distance (e.g., mileposts) and/or time. The plan profile may also include train operating limits, such as maximum notch power and/or brake settings, speed limits as a function of location, and expected fuel usage and emissions generated. The (first) synchronous plan profile may further comprise estimating operating parameters based on the synchronous settings of the synchronous plan profile. Thus, the first synchronous plan profile may include synchronous locomotive notch settings and estimated operating conditions corresponding to the synchronous locomotive notch settings for the locomotives over the designated route. The synchronous settings may include setting the plurality of locomotives to a common notch. Thus, if the master locomotive is commanded to be motoring at notch 8, all slave locomotives may also be commanded to motor at notch 8.

At 412, the routine may automatically identify regions in the synchronous plan where the train may be operated in the independent mode. Specifically, the routine may assess the synchronous plan for regions where operating parameters may be at or near limits, and wherein operating in the independent mode may provide performance improvements. For example, the automatically identified region may be based on the synchronous locomotive notch settings and estimated operating conditions of the first plan profile. The synchronous plan may be used to predict future operating conditions in the mission, and based on the defined limits, adjustments for independent locomotive settings may be computed for those anticipated operating conditions. In one example, the limits may be predefined "independent mode limits" which may, as such, differ from limits used by the controller when determining the synchronous plan. For example, notch settings and/or ranges permitted in the independent plan may be different (for example, more restricted) than the settings permitted in the synchronous plan. As further elaborated with reference to FIG. 5, the routine may automatically identify regions with, for example, undulations, sags, and crests, wherein vehicle operating parameters are close to predefined limits. For example, the routine may automatically identify such regions based on the synchronous plan profile and a track database providing details of the terrain along the train's route. In one example, the at least one automatically identified region may include regions on the (first) synchronous plan profile where a selected synchronous settings is above a threshold. For example, the synchronous setting may be one of a rate of change of notch and a rate of change of tractive effort.

In another example, the at least one automatically identified region may include regions in the (first) synchronous plan profile where an estimated operating parameter of the first plan profile is above a threshold. The estimated operating parameter may include at least one of a coupler force, a number of nodes and a node motion of the synchronous plan profile. For example, the routine may include automatically identifying regions with high transient coupler forces (if using a complex force model) and/or regions with prolonged duration of high coupler forces. In still another example, the routine may include automatically identifying regions with the potential for high coupler force transients (if using a simplified force model), or regions with a large number of "nodes" or rapid node motion. For example, the automatically identified region may include regions of the synchronous plan where the number of nodes is greater than a threshold. The estimated operating parameters may also include, for example, undulation parameters, crest parameters and/or sag parameters of the synchronous plan profile. Further still, other operating parameters may be monitored.

Following automatic identification of regions in the synchronous plan that may be potentially updated with independent segments, at 414, the routine may determine a second independent plan profile (herein also referred to as an independent plan), including independent locomotive notch settings, for the locomotives over the at least one automatically identified region, based on the original synchronous plan profile, and based on track parameters (for example, from a track database). For example, the independent locomotive notch settings may be based on the synchronous locomotive notch settings and estimated operating conditions of the first plan profile. In one example, it may be determined whether an independent plan is possible and/or feasible in the identified regions, and if so, the routine may generate an independent plan for the identified regions. The settings in the second independent plan may be selected such the net power distributed between the locomotives does not differ from the net power distributed in the synchronous plan profile. In another example, a remote consist power setting (at a given distance) may be selected as a function of the synchronous plan profile power setting over a window while the lead consist power setting may be selected to attain the same total power as the synchronous plan profile. As further elaborated with reference to FIG. 6, generating an independent plan for the identified region may include defining independent mode limits (e.g., lead consist cannot be in motoring when the remote consist is in braking) and notch bounds (e.g., remote consist cannot be above notch 3 when the lead consist is braking), and determining independent mode windows around the identified region based on predefined cost functions and operating parameter limits. An independent plan profile may then be generated for the identified independent window(s) based on the original synchronous plan profile.

It will be appreciated that the independent plan profile may be generated in a number of different ways. In one embodiment, the lead and remote notches may be determined to optimize a selected cost function (or functions) over a window. As further elaborated in FIG. 6, the cost function may include a number of nodes, a degree of node motion, rate of change of notch (or horsepower, or TE), end point constraints (e.g., starting and ending notch matching the synchronous plan notch), or peak forces. In another embodiment, the notches maybe determined based on a function of the synchronous plan within the selected window, or an alternate window. It will be appreciated that in one embodiment, the window may include the entire trip. For example, the function may include determining the remote notch to be the maximum of the plan notch in the window, subject to predefined independent mode bounds, limits, and constraints. In another example, the function may include a statistical function, such as a mean, mode, or median value. In still another example, the function may include determining the remote notch be a fixed offset, or an offset related to a train parameter such as train length, while looking at other plan parameters, such as speed. Independent settings in the second independent plan profile may also be determined by selecting a lead and remote consist power according to at least one of a track parameter, a train parameter, and an operating parameter. Track parameters may include parameters such as the raw track grade at each consist, an average grade of the train from each consist to adjacent nodes, train weight distribution, locomotive consist locations, coupler forces, node locations, etc. Further, additional operational rules may be incorporated when determining the independent mode settings that may force or limit the power settings (or notch and brake settings) of one or more locomotive consists.

At 416, the routine may update the identified regions of the synchronous plan with the computed independent segments. In this way, a train may be operated in a synchronous mode with a synchronous trip plan wherein trip details are optimized based on operating conditions. Based on the potential for further performance improvement, regions of the synchronous trip plan may be updated with independent settings. In this way, by providing independent updates, trip optimization processing may be simplified and processing times may be reduced.

At 404, the updated trip plan may be implemented. That is, a train control system may take action according to the updated plan profile. For example, the determined throttle notch settings on the locomotives may be implemented, and the determined brake settings may be implemented. Specifically, segments of the final plan that are based on the synchronous plan profile, synchronous settings, such as synchronous common notch settings, may be implemented on all the locomotives. Then, during segments of the final plan that are based on the independent plan profile, independent settings, such as different notch settings for the different locomotives, may be implemented. In one example, taking action may include generating a report about the synchronous plan profile and the independent plan updates. The report may then be used for future operator training purposes. In alternate examples, taking action may include providing prompts (such as visual prompts) to a train operator to control the plurality of locomotives of the train based on the synchronous and/or independent plan profile. The prompts may include, for example, explicit notch prompts for each consist, notch prompts for the one or more independent regions, etc.

Trip implementation may further include, at 420, following implementation of the second independent plan profile, making real-time adjustments to the independent segments of the trip plan. As further elaborated with reference to FIG. 7, performing real-time adjustments may include, continuously monitoring real-time operating conditions of the train and/or each locomotive during the independent segments. The monitored real-time operating conditions may include, for example, a number of nodes, and/or a train speed. Further, in the event that an operating condition is limited (or may become limited) during an independent segment, or in the event that an operating condition varies from a threshold value, the real-time adjustments may include adjusting the independent settings for that segment, for example, making real-time adjustments to the independent locomotive notch settings, based on differences between monitored real-time operating conditions and threshold values. In one example, the adjustment may include, modifying the notches to maintain plan speed while maintaining one or more alternate operating parameters. In another example, the adjustments may include, modifying the notches to violate the plan speed while maintaining one or more other operating parameters, such as other more critical operating parameters. These parameters may include, for example, peak forces, number of nodes, node motion, node position, notch/mode bounds, operator behavior, notch rate of change, TE rate of change, horsepower rate of change, consists TE limits, etc.

As previously elaborated, the controller generating the plan profile may be an on-board controller or a remote controller located at a remote location, such as the dispatch center. In alternate embodiments, certain segments of the plan profile may be generated on an on-board controller while other segments may be generated on the remote controller. For example, the synchronous plan profile may be generated on the on-board controller while independent segment updates and/or real-time adjustments may be determined by the remote controller and communicated to the on-board controller. The remote controller may be, for example, an off-board advisor. The off-board advisor may use similar logic and rules to advice of possible independent settings. For example, the off-board advisor may be used to provide advice regarding potential new customer requirements, possible subdivisions, possible new train make-ups, etc. The advisor may calculate numerous combinations of different train make-ups and territories, and provide specific feedback regarding potential independent regions and suggest potential notch profiles.

In particular, there may be some situations in which it is either too costly or too difficult to equip a locomotive with a controller capable of performing all the calculations and methods contained herein. In these cases, the same algorithms and methods may be employed in an off-line fashion, for example, by the off-board advisor, and communicated to the railroad personnel for implementation on the locomotive at dispatch. In one example, the independent segments and associated plan profile updates may be determined offline by a stationary server for one or more train configurations and subdivisions. Metrics related to the performance of all the configurations may be calculated. Railroad management may then experiment with the different configurations and evaluate the performance of distributed power on a new subdivision. In addition, locomotive engineers can be provided with a description of likely independent regions and suggested operating practices.

In this way, the routine enables the train to be operated in a synchronous mode using a synchronous plan profile, while updating segments of the synchronous plan with independent segments, when and where possible, to thereby improve overall vehicle performance.

Now turning to FIG. 5, a routine 500 is described for automatically identifying regions in the synchronous trip plan for a train that may be updated with independent segments. A controller may be configured to identify regions in the synchronous plan wherein operating parameters may be at or near a threshold. The automatically identified regions may be identified based on the first synchronous plan profile, train characteristics, track database, and/or terrain features of interest. As elaborated below, terrain features of interest may include features such as undulations, crests, and sags. By modifying the identified regions with independent segments, additional vehicle performance benefits may be attained.

At 502, the routine may confirm if there are undulation regions. As such, undulation regions may be defined as regions wherein some significant segment(s) of the train are on an uphill grade and some significant segment(s) of the train are on a downhill grade. If undulation regions are confirmed, then at 504, it may be determined whether undulation parameters in the undulation regions are at or near limits. This may include, for example, determining if the number of uphill and downhill regions or locomotives in the train length is greater than a threshold (for example, if more than 3 significant segment(s) of the train are uphill or downhill). In another example, the length of each uphill and/or downhill region may be determined and it may be determined if the length of any region is greater than a threshold (for example, more than 25% of the train length). In still another example, the grade of each uphill and/or downhill region may be determined and it may be determined if the absolute grade of any region, or the maximum grade change from an adjacent region, is greater than a threshold (for example, more than 0.3%). If undulation parameters are confirmed to be at or near the predefined limits, then the routine may proceed to 516 to select that region for an independent update and determine independent settings for that region. In contrast, if the undulation parameters are not near the predefined limits, the routine may proceed to 506.

At 506, the routine may confirm if there are any crest and/or sag regions. In one example, the crest and/or sag regions may be identified based on the synchronous plan profile and/or a track database. As such, a crest region may be defined as a terrain feature where the grade changes rapidly, relative to a characteristic of the train (e.g., length of train, weight distribution, consist characteristics, etc), from positive to negative. Conversely, at a sag region, the grade changes rapidly from negative to positive relative to the characteristics of the train. If crest and/or sag regions are confirmed, then at 408, it may be determined whether crest and/or sag parameters in the crest and/or sag regions are at or near limits. This may include, for example, the extent of correlation of the identified crest and/or sag with a pattern crest and/or sag. In another example, the maximum grade or grade change of each crest and/or sag region may be determined and it may be determined if the absolute grade of any region is greater than a threshold, for example, more than 1%, or an absolute change of more than 2% (e.g., +1% to −1%). While the depicted example illustrates similar threshold for both crest and sag regions, in alternate example, the limits for crest region and sag regions may be independently adjusted. If crest and/or sag parameters are confirmed to be at or near the predefined limits, then the routine may proceed to 516 the identified region may be selected for an independent update and independent settings may be determined for the identified region. In contrast, if the crest and/or sag parameters are not near the predefined limits, the routine may proceed to 410.

At 510, train coupler forces may be estimated and high coupler force regions (for example, regions with coupler forces greater than a threshold) may be identified. In one example, the coupler forces may be estimated using coupler force sensors. In another example, the coupler forces may be predicted based on virtual displacement models (simplified or complex force models) that predict train coupler forces. Independent plan profile settings may then be determined based on the estimated (and/or predicted) train coupler forces. If high coupler force regions are determined, the identified region may be selected for an independent update and independent settings may be determined for the identified region. If high coupler force regions are not determined, the routine may proceed to 512.

At 512, it may be determined whether a number of nodes is at or near limits. For example, it may be determined whether the number of nodes is greater than 3. As previously elaborated, node behavior may correspond to regions of high transient coupler forces. Thus, in the presence of a large number of nodes, high equipment component stress may be anticipated. If the number of nodes is greater than the threshold, at 516, the high node region may be selected for an independent update and an independent plan may be determined for the identified high node region. In contrast, if the number of nodes is not limiting the routine may proceed to 514. In alternate embodiments, additionally or optionally, the automatically identified region may be determined based on node motion, or a rate of change of node position. High node motion may be quantified by calculating a total tonnage that switches from one side of a node to another when the node moves. Thus, a region of high node motion, where nodes are rapidly moving, may be automatically selected for an independent update and independent profile settings may be determined for the identified region. In still other embodiments, the automatically identified region may be selected based on the position of nodes and/or the distance between nodes. In still other examples, the automatically identified region may be selected based on tractive effort limits (such as an amount of tractive effort or a rate of change of tractive effort).

At 514, the routine may determine if there are any other regions with alternate operating parameters that are at or near limits. If yes, the routine may proceed to 516 to select that region for an independent update and determine an independent plan for that region. Else, the routine may end. In one example, the automatically identified regions may include regions of the synchronous plan profile with frequent notch changes. Such regions may then be selected for independent plan profile updates. By replacing the synchronous plan profile settings in the identified regions with independent plan profile settings, frequent notch changes on the remote locomotive may be reduced. By reducing the number of notch changes on the remote locomotive, a more stable train operation may be enabled.

Now turning to FIG. 6, an example routine 600 is depicted for determining independent settings for the automatically identified regions of the synchronous plan, as identified in FIG. 5, based on synchronous plan settings. Specifically, the routine enables the synchronous settings of the region(s) identified in FIG. 5 to be replaced with independent settings.

At 602, independent mode cost functions may be determined. In one example, the cost functions for the independent mode may be previously input into a controller by an operator. The cost functions may include, for example, fuel efficiency. Thus, independent mode settings may be adjusted to optimize fuel efficiency in the identified region while keeping coupler forces in an acceptable range and while ensuring that the operator demanded power is provided even after the power redistribution. In another example, the cost functions may include exhaust emissions. Thus, independent mode settings may be adjusted to minimize exhaust emissions in the identified region. In still another example, the cost functions may include time restrictions. Thus, independent mode settings may be adjusted to ensure that the train covers a defined distance within a defined time in the identified region. The time restrictions may include, for example, ensuring a desired time of arrival and/or a defined speed profile. Other cost functions may include, for example, minimal train or coupler forces, minimal notch polarity differences, minimal nodes, tractive effort, speed and/or acceleration, end point constraints, etc. In one example, a plurality of cost functions may be used to compute the independent mode settings, based on predefined weightings of the cost functions.

At 604, independent mode limits may be determined based on the determined cost functions. This may include determining settings that are not permitted in the independent mode. In one example, the independent mode limits may also include predefined "independent mode rules" differing from corresponding limits in the synchronous mode. In one example, when the cost function is fuel efficiency, the independent mode limits may include a threshold notch difference between the lead locomotive and the most remote locomotive. In another example, the independent mode limits may include restricting slave or remote locomotive notches (or power settings) based on a master or lead locomotive notch (or power setting). For example, when the lead locomotive is in a braking mode, the remote locomotive may be restricted to notches at or below notch 3. By restricting the motoring capacity of the remote locomotive in response to the braking of the lead locomotive, the use of air brakes on the remote locomotive may be reduced, thereby providing performance and fuel efficiency benefits. In another example, when the lead locomotive in motoring, the remote locomotive may not be allowed to brake. Independent mode limits may further include, restricting a number of nodes (for example, within a range), and restricting node motion (for example, limiting the rate of change of node motion or node weight movement within a range).

In one example, the limits enforced at 604 may be strict limits wherein the degree (or amount) of deviation of settings from the synchronous plan profile may be restricted. For example, notch setting deviations may be restricted. In another example, the limits may include some leniency. In still another example, independent mode limits may include restricting an amount of deviation of a first independent plan setting from the corresponding synchronous plan setting while permitting an amount of deviation of a second independent plan setting. For example, while notch setting deviations may be permitted (albeit restricted) in the independent plan profile, speed deviations (for example, in certain regions) may not be allowed. By restricting a degree of deviation, the impact of the changes from the first plan profile settings to the second plan profile settings may be reduced, if so desired.

The "independent mode rules" may be, for example, train, locomotive, consist, and/or location specific. For example, certain notches may be limited (or not permissible) at pre-specified locations (e.g., mileposts) when operating through that location in the independent mode, while they may be permissible in the synchronous mode. The independent plan profile may include track mode markers to enforce such limits. In one example, it may also be determined, based on the cost functions and the determined mode limits, whether an independent plan is possible and/or feasible. For example, if based on the cost functions it is determined that the independent mode limits are very narrow (for example, less than a threshold), it may be decided to not perform independent plan updates and return to the default synchronous plan profile settings.

At 606, an independent mode window may be defined for each region previously identified, based on the determined independent mode limits. The window may be further determined based on settings determined and/or predicted in the synchronous plan profile. For example, the window for the region selected for independent plan updates may be determined using the synchronous plan profile as a reference. In one example, the window, and independent plan updates therein, may be determined based on synchronous plan profile settings preceding and following the identified region, both in time and in distance. In another example, the window may be determined based on a train database. For example, a size and/or distribution of the window may be determined based on the history of other trains that have performed the same or similar missions, and/or based on the history of the same train during previous missions (same or similar or different missions). In still another example, the window may be determined based on a track database. For example, a size and/or distribution of the window may be determined based on the terrain profile preceding and following the identified region. In yet another example, the window may be based on an alternate train parameter, such as a total train length.

In one example, the window may be defined in terms of distance (e.g., mileposts) from the head of the train (HOT) and/or the end of the train (EOT). In another example, the window may be defined in terms of locomotives and/or cars. In one example, the window may be centered on HOT or EOT. Further, the window may include distances before and/or after the train. The window may be symmetric or asymmetric. In one example, a crest region in the synchronous plan with a high rate of node motion may have been previously identified. To address potential issues arising from the high rate of node motion therein, independent settings for the plan may be determined starting 1 mile before the arrival of train in the crest region and extending for 1 mile after the passing of the train past the crest region. While the mentioned example includes a symmetric window, it will be appreciated that in other example, the window may be asymmetric, encompassing, for example, a larger distance before the HOT and a smaller distance after the EOT.

In one example, the window may be determined offline by a remote locomotive controller, and then uploaded to the on-board controller of a train's lead locomotive. In another example, the window may be imported from a train database on the remote controller. The window may be determined a priori on the remote controller, or may be determined in real-time, for example during real-time adjustments.

At 608, independent plan settings may be determined for the identified regions based on defined windows, cost functions and limits. Specifically, the independent plan settings may be determined based off the synchronous plan settings, in view of the defined bounds and limits. The independent plan settings may be further based on a track database. Thus, for example, notch settings and/or a distribution of the settings among the locomotives in the independent mode may be selected to limit (or minimize) steady state forces, minimize nodes, reduce transient coupler forces, etc. and to redistribute power between the locomotives without affecting the net train power. The power may be distributed based on track grade, peak coupler forces, etc. For example, when the train is on a track wherein part of the train is uphill and part of the train is downhill, the synchronous plan settings may be updated with independent settings to enable more motoring power to be provided to the locomotive(s) that are hauling uphill while reducing motoring power from the locomotive(s) that are rolling downhill. Once the settings have been determined, synchronous plan settings of the identified regions may be replaced with the independent plan settings as determined herein, thereby generating a final train plan.

In one example, the estimated operating conditions of the first synchronous plan profile may include a number of nodes in the train. Automatically determining at least one region of the first plan profile may include identifying operating conditions of the first plan profile where the number of nodes in greater than a threshold, and then determining a window around the operating condition to generate the at least one region, the size of the window based on the synchronous locomotive notch settings of the first plan profile.

In one example, the independent plan settings may be implemented automatically (e.g., an auto control mode), and without operator input. In another example, the updated settings may be indicated to the operator, for example, displayed on an on-board display system, and the settings may be implemented by the operator by actively adjusting the notch of one or more locomotives (e.g., an explicit notch advisement mode). It will be appreciated that the synchronous plan processing and post-synchronous plan processing may be performed by the locomotive controller before the dispatch of the train so that upon dispatch, the train can follow the determined plan profile with minimal operator input. Changes performed in the mission may be noted and stored in a train database for use during future independent upgrades for the same train on the same mission, different trains on the same mission, and/or different trains on different missions. In this way, by processing a train plan based on operator preferences, operating conditions, and anticipated issues, train plan profiles may be computed to provide improved performance while minimizing operator input during vehicle operation. By reducing the need for operator input during train mission planning and implementation, operational errors may be reduced.

Now turning to FIG. 7, an example routine 700 is described for performing real-time adjustments to a train plan profile. Specifically, independent segments of the final train plan may be monitored, and in response to deviations from the plan and unexpected changes in operating conditions, the independent settings may be revised based on the original synchronous plan profile. The real-time adjustments may be implemented automatically (e.g., in an auto control mode), without operator input, or may be indicated to the operator in real-time, (e.g., displayed on an on-board display system) and the settings may be implemented by the operator by actively adjusting the notch of one or more locomotives in real-time (e.g., in a real-time advisement mode).

At 702, train operating conditions in the independent segments may be continuously monitored following implementation of the second plan profile. At 704, it may be determined whether there are any differences between the monitored real-time operating conditions and threshold values. Alternatively, it may be determined whether actual train settings (such as power settings) have deviated from the independent plan profile settings, for example, by a threshold amount. If there are no deviations, the routine may end. If there are differences between the monitored real-time operating conditions and the threshold values, independent profile settings, such as independent locomotive notch settings, in those segments may be adjusted or revised in real-time at 706. For example, the routine may include monitoring actual coupler forces (for example, as measured by coupler force sensors), and making adjustments to the independent plan settings based on actual coupler force data (for example, due to coupler forces being above a threshold).

The adjustments may include modifying the notches to maintain the independent plan speed while also maintaining one or more other operating parameters. The adjustments may be based on notch rules as specified in a database. Alternatively, the adjustments may include modifying the notches to violate the independent plan speed so as to maintain one or more other, more critical, operating parameters. These may include, for example, node characteristics, notch characteristics, TE limits, etc. Additionally, unplanned braking limits may also be enforced on a total train horsepower basis.

In one example, the monitored real-time operating condition may be a train speed, and the real-time adjustment may include, modifying the independent locomotive notch setting to bring the train speed within the threshold value. In one example, when performing real-time adjustments, it may desirable to minimize notch changes on remote locomotives (or consists). Thus, modifying the independent locomotive notch setting may include, in one example, changing (e.g., increasing) a lead notch while maintaining remote notches, such that a notch difference between the increased lead notch and the maintained remote notches is within a threshold or predefined notch bound/limit. In one example, the database may include a notch rule defining how the remote notch may be limited with reference to the lead notch. For example, the remote notch limit may be defined by the algorithm remLimit=max {2, min(5/2*leadNotch+5.5, 8)}, that is, the maximum of notch 2, and the minimum of a notch that is 5/2 times the lead notch plus 5.5, and notch 8. In yet another example, if the lead notch exceeds the remote notch by a threshold, the independent settings may be returned to the synchronous settings, or modified to a revised independent setting that is a revised function of the synchronous setting.

In this way, the real-time adjustments may enable deviations from the independent plan power setting to regulate plan speed using adjustments to the lead notch only, while allowing the remote notches to follow the planned remote notch profile, as long as predefined independent mode notch limits are not violated. In another example, modifying the independent locomotive notch setting may include, changing (e.g. increasing) a lead notch while also increasing a remote notch, to maintain a notch difference between the increased lead notch and the increased remote notch within the threshold. In this way, remote notch changes may be restricted, and may be performed only to maintain predefined notch differences as specified in the independent plan profile.

In another example, the monitored real-time operating condition may be a number of nodes, and the real-time adjustment may include, modifying the independent locomotive notch setting to bring the number of nodes within the threshold value, while maintaining a train speed setting of the second independent plan profile. Alternatively, the adjustment may include, modifying the independent locomotive notch setting to bring the number of nodes within the threshold value, without maintaining the train speed setting of the second independent plan profile. In this way, the notch settings may be adjusted to violate a first operating condition (such as, train speed setting) to maintain a second, more critical (or higher weightage) operating condition (such as, number of nodes).

In still another example, if the deviation is more than a threshold amount, cost functions, independent mode limits, and/or windows may be revised, and new independent plan settings may be determined based on the revised bounds and limits. For example, a rolling window may be used to make the real-time adjustments.

In yet another example, tractive effort limits may be continuously monitored in real-time. Herein, if peak coupler forces on either side of an identified region (e.g., a consist) exceeds a threshold, or if the average rate of tractive effort change exceeds a limit, the independent plan settings for that segment may be replaced with the corresponding synchronous plan settings. In another example, notch limits may be continuously monitored in real-time. Herein, if notch rules deviate from the "independent mode rules", independent plan settings may be returned to default synchronous plan settings. For example, the notch for the remote locomotive may be limited as a function of the lead locomotive notch, and deviations from that notch may trigger a real-time reversal of settings closer to the synchronous plan profile settings. In another example, in response to speed deviations from expected values, speed control may first be attempted, when possible, by adjusting the lead locomotive notch to thereby adjust the lead locomotive power. However, if a lead locomotive power adjustment is not possible, speed control may be attempted, following lead locomotive notch saturation, by adjusting the remote locomotive notch to thereby adjust the remote locomotive power.

Now turning to FIG. 8, an example routine 800 is described for generating a fully independent plan profile and performing real-time updates on the plan. In one example, a fully independent plan may be generated in response to a request for a higher degree of optimization of locomotive settings over a planned travel route. As such, an optimization routine configured to generate the fully independent plan may include algorithms with multiple variables. The multiple variables may include, for example, n notches for the n number of locomotive consists in the train (that is, a lead consist (n−1) remote consists). Herein, it may be assumed that the 'n' consists can be controlled with independent notches. In one example, where fuel economy is a constraint when generating the fully independent plan, the optimization routine may be solved for minimization of fuel as follows, $$\text{Min } \text{fuel}_1+\text{fuel}_2+\ldots+\text{fuel}_n$$

Subject to
Train Dynamics
Speed Limits $$|dp_k/dt|\leq r_k$$

Arrival time≤ETA where $\text{fuel}_k$ is the fuel (over the entire trip) consumed by consist k (k=1, . . . , n). Constraints related to train dynamics (Train Dynamics) may enforce that an optimal solution to the fuel minimization problem respect a physics-based model of the train, which may be either a simple lumped-mass model, or more involved, distributed models. Similar constraints related to train speed limits (Speed Limits) may also be enforced. Constraints may also be imposed on the rate of change of consist power ($p_k$). Since consist power is a function of notch, the constraint may indirectly represent a bound on the rate of change of notch. As such, relatively fast variations of train notch may make difficult for a train operator and/or a locomotive controller to follow the planned notches of the plan profile. Thus, by imposing a constraint on the rate of change on notch and consist power, the ease of control of the train and train-handling may be improved.

Different bounds may be used on the lead consist and on each of the remote consists, the bounds tuned for ease of control. In one example, consist-specific constraints may be imposed by applying a penalty on notch rate of change as follows, $$\text{Min } \text{fuel}_1+\text{fuel}_2+\ldots+\text{fuel}_n+\sum_{k=1}^{n}c_k\int|dp_k/dt|^2dt$$

Subject to
Train Dynamics
Speed Limits $$|dp_k/dt|\leq r_k$$

Arrival time≤ETA where, $c_k$ are weighting parameters for each consist which impose a penalty on integrated notch rate-of-change for the corresponding consist. By tuning a given $c_k$ upwards, a larger penalty may be imposed, thereby enforcing a smoother behavior on a given consist. In still another example, similar results could be achieved by using tractive efforts $F_k$ from each consist as optimization variables instead of $p_k$.

The optimization algorithms described may be further adjusted based on the model and configuration of the physical train the settings are planned for. Further, various additional constraints related to train-handling may be imposed on the optimization algorithms of the fully independent plan optimization routine. For example, to keep coupler forces small, a penalty term may be imposed for coupler forces as follows, $$\text{Min } \text{fuel}_1+\text{fuel}_2+\ldots+\text{fuel}_n+\sum_{k=1}^{n}c_k\int|dp_k/dt|^2dt+f_1\max(F_c,0)-f_2\min(F_c,0)$$

Subject to
Train Dynamics
Speed Limits $$|dp_k/dt|\leq r_k$$

Arrival time≤ETA where, $F_c$ is the profile of coupler forces across the length of the train. Thus, $\max(F_c, 0)$ represents the maximum tensile force, similarly, $\min(F_c, 0)$ represents the minimum tensile force. Herein, weighting parameters $f_1$ and $f_2$ can be different from each other, indicating that tensile forces may be penalized heavier than compressive forces, since the couplers can usually tolerate much larger compressive forces than tensile forces before degrading.

Still other constraints that can be incorporated in the algorithms may include, for example, reducing the number of nodes (that is, points on the train where train forces change from tensile to compressive or vice versa), reducing or limiting the motion of nodes, limiting node positions, limiting notch bounds, etc. Furthermore, additional operational rules may be incorporated when determining the fully independent mode settings that may force or limit the power settings of one or more locomotive consists. By generating a fully independent plan and operating the train according to the fully independent plan, fewer adjustments and deviations from the original plan may be required to satisfy constraints arising during travel in comparison to the synchronous plan with independent updates.

Returning to routine 800, at 802, the routine includes determining fully independent mode cost functions for each consist. This may include determining cost function coefficients and constraints for each consist, etc. As previously elaborated with reference to the independent updates of FIG. 6, the cost functions may include, for example, fuel efficiency (that is, the fully independent plan may be adjusted to optimize fuel efficiency over the entire route while keeping coupler forces in an acceptable range and while ensuring that the operator demanded power is provided even after the power redistribution), exhaust emissions (that is, the fully independent plan may be adjusted to minimize exhaust emissions over the entire route), time restrictions (that is, the fully independent plan may be adjusted to ensure that the train covers the defined distance of the route within the defined time, with or without some margin), etc. Other cost functions may include, for example, minimal train or coupler forces, minimal notch polarity differences, minimal nodes, tractive effort, speed and/or acceleration, end point constraints, etc. In one example, a plurality of cost functions may be used to compute the fully independent plan, based on predefined weightings of the different cost functions.

At 804, the routine may include determining fully independent mode limits for each consist based in the determined cost functions. These may include determining settings that are not permitted in the fully independent mode. In one example, these limits may be substantially similar to the independent mode limits imposed when generating the independent plan of FIG. 6. In another example, the limits imposed during independent and fully independent modes may lie within a range, the limits imposed during the independent mode towards one end of the range, while the limits imposed during the fully independent mode towards the other end of the range. In still other examples, the limits imposed during independent and fully independent modes may be distinct. In one example, where the cost function is fuel efficiency, the fully independent mode limits may include threshold notch differences between the lead locomotive and each of the remote locomotives. In another example, the fully independent mode limits may include restricting each remote locomotive's notch (or power settings) based on the lead locomotive's notch (or power setting) and/or the notch of the immediately preceding locomotive. As elaborated above, fully independent mode limits may also include, restricting a number of nodes (for example, within a range), and restricting node motion (for example, limiting the rate of change of node motion or node weight movement within a range). In one example, the rate of node motion may be determined according to the position of a car of the train. In another example, the rate of node motion may be determined according to the weight of one or more train cars transitioning from one side of the node to another side. It will be appreciated that the limits imposed during the fully independent mode may include limits discussed above, as well as limits imposed during the independent mode, as elaborated above with reference to FIG. 6 (and not repeated herein for brevity).

At 806, based on the determined cost functions and limits, and other constraints imposed (such as those elaborated above, including limits on node number, node motion, node position, node rate of change, tractive forces, couple forces, notch rate of change, fuel usage, etc.), a fully independent plan may be generated and the train may be operated according to the fully independent plan with independent settings over the entire route. The fully independent plan settings may be further based on a track database. Thus, for example, notch settings and/or a distribution of the settings among the locomotives in the independent mode may be selected to limit (or minimize) steady state forces, minimize nodes, reduce transient coupler forces, etc. and to redistribute power between the locomotives without affecting the net train power. The power may be distributed based on track grade, peak coupler forces, etc.

After the fully independent plan is generated, settings and operating conditions may be continuously monitored for potential improvements through real-time updates. Thus, at 808, the operating conditions and fully independent mode settings may be continuously monitored, and in response to deviations from the plan and unexpected changes in operating conditions, the fully independent settings may be revised based on defined cost functions and limits. In one example, the cost functions used to revise the fully independent settings may be substantially the same as those used to generate the fully independent plan. In another example, the cost function used to revise the fully independent settings may be different from those used to generate the fully independent plan. The real-time adjustments may be implemented automatically (e.g., in an auto control mode), without operator input, or may be indicated to the operator in real-time, (e.g., displayed on an on-board display system) and the settings may be implemented by the operator by actively adjusting the notch of one or more locomotives in real-time (e.g., in a real-time advisement mode).

At 810, it may be determined if any operating conditions are at or near a limit. Additionally, or optionally it may be determined whether there are any differences between the monitored real-time operating conditions and threshold values, or whether actual train settings (such as power settings) have deviated from the fully independent plan profile settings by a threshold amount, for example. If not, the routine may end. However, if any operating condition is at or near a limit, then at 812, the settings of the fully independent plan may be adjusted in real-time based on the defined cost functions and constraints. For example, the routine may include monitoring actual coupler forces (for example, as measured by coupler force sensors), and making adjustments to the fully independent plan settings based on actual coupler force data (for example, due to coupler forces being above a threshold). The adjustments may include modifying the notches to maintain the fully independent plan speed while also maintaining one or more other operating parameters. The adjustments may be based on locomotive-specific notch rules as specified in a database. Alternatively, the adjustments may include modifying the notches to violate the fully independent plan speed so as to maintain one or more other, more critical, operating parameters. These may include, for example, consist-specific node characteristics, notch characteristics, TE limits, etc. Additionally, unplanned braking limits may also be enforced on a total train horsepower basis.

In one example, the monitored real-time operating condition may be a train speed, and the real-time adjustment may include, modifying the fully independent locomotive notch settings to bring the train speed within the threshold value. In one example, when performing real-time adjustments, it may desirable to minimize notch changes on remote locomotives (or consists), such as by imposing notch rules. In another example, if the lead notch exceeds any remote notch by a threshold, the fully independent settings of that remote locomotive may be revised.

Other real-time adjustments may include, for example, adjustments based on notch limits, number of nodes, tractive effort limits, coupler forces, etc., as previously elaborated with reference to FIG. 7. In still another example, in response to speed deviations from expected values, speed control may first be attempted, when possible, by adjusting the lead locomotive notch to thereby adjust the lead locomotive power. However, if a lead locomotive power adjustment is not possible, speed control may be attempted, following lead locomotive notch saturation, by adjusting one or more remote locomotive notches (for example, sequentially, or in concert) to thereby adjust the remote locomotive power.

In alternate embodiments, the fully independent plan profile may be generated based on the first synchronous plan profile and/or the second independent plan profile. For example, generating a fully independent plan profile may include using the first synchronous plan profile as an initial solution for lead and remote fully independent settings, and then optimizing the synchronous settings over the entire route for each locomotive based on operational rules, cost functions, and constraints. Herein, the operational rules and constraints may be imposed in a locomotive-specific manner. In another example, generating the fully independent plan profile may include starting with the synchronous plan profile, automatically identifying one or more independent regions for updating with independent settings, and when the number of independent regions is greater than a threshold, automatically requesting a higher degree of optimization. The window of the independent region may then be extended to the entire route, and fully independent settings for each locomotive over the entire route may then be generated so as to operate the train with the fully independent plan profile.

In one example, the train may include three locomotive consists, each locomotive consist including a car. The train mission may include travel from a starting point A to an ending point B, the mission to be covered over 24 hours. Based on vehicle operating conditions at the time of departure, and based on vehicle operating conditions predicted and/or estimated along the mission, a synchronous plan profile with synchronous settings may be requested and accordingly determined. For example, based on weather conditions at A at the time of departure, weather conditions at B at the time of arrival, track conditions along the route, cargo details, stop details, etc, a first synchronous plan profile may be determined. The synchronous plan profile may then be automatically reassessed for regions that may benefit from independent updates. For example, a first region may be identified, for example at mile marker C, wherein the number of nodes is high. Based on synchronous plan settings in the first plan profile at, before, and after mile marker C, a window may determined around location C for performing independent updates. For example, the region may include a region 1 mile before mile marker C and a region 1 mile after mile marker C.

Similarly, a second region may be identified, for example at mile marker D, wherein the train passes through an undulation region such that one of the locomotive consists (e.g., the lead consist) is on a higher steep (going uphill) while the remaining remote consists are on a lower steep (going downhill). Based on estimated operating conditions (including undulation parameters) at location D, and further based on synchronous plan settings in the first plan profile at, before, and after mile marker D, a window may determined around location D for performing independent updates. For example, the region may include a region 3 miles before mile marker D and a region 1 mile after mile marker D. Further, the notch settings may be adjusted. For example, the synchronous plan profile settings may include all locomotives at notch 4. In comparison, the independent plan profile settings may include providing more power to the lead locomotive that is hauling uphill (for example, by shifting the lead locomotive to notch 6) while reducing power provided to the remote locomotives rolling downhill (for example, by shifting the remote locomotives to notch 3).

Following dispatch, the operating conditions of the train may be continuously monitored, for example, in the defined windows around mile marker C and D. In one example, no deviation from expected settings may be seen at mile marker C. Consequently, no further adjustments may be made to the independent settings in that region. In another example, a deviation from expected settings may be seen at mile marker D. Consequently, further real-time adjustments may be made to the independent settings in that region. In one example, to enable the train to maintain the planned speed without grossly affecting the remote notches, the lead locomotive may be readjusted to notch 7 while maintaining the remote locomotives at notch 3.

In another example, the lead locomotive may be at notch 6, a first remote locomotive may be at notch 3, and a second remote locomotive may be at notch 4. Herein, in the event of deviation of train speed from the plan speed, real-time adjustments may include readjusting the lead locomotive to notch 7 to enable the train to maintain the planned speed. However, independent mode limits may further restrict notch differences between lead and remote locomotives to 3 notches. Consequently, the first remote locomotive notch may also be readjusted to notch 4, while the second remote locomotive notch is maintained at 4. Thus, real-time adjustments may be performed within independent mode bounds and limits while minimizing remote notch changes.

In an alternate example, for the same train mission including travel from starting point A to ending point B, the mission to be covered over 24 hours, a higher degree of optimization may be requested. In response to the request, based on vehicle operating conditions at the time of departure, and based on vehicle operating conditions predicted and/or estimated along the mission, a fully independent plan profile with fully independent settings may be generated along the route. Specifically, optimized fully independent settings may be generated for the entire route, for example, from a point where the train is loaded, the configuration of locomotives and cars is determined, and/or from where the train starts the journey, to a point where the train is unloaded, locomotives and cars are reconfigured for a new route, and/or where the train ends the journey. The fully independent settings for each locomotive may be determined based on vehicle operating parameters and locomotive-specific cost function coefficients. Thus, for the entire route, the notch settings and brake settings for each trailing locomotive, for example, may be adjusted differently than the notch setting and brake setting for the lead locomotive. Further, the fully independent settings of each locomotive may be monitored during vehicle operation and may be adjusted in real-time based on differences between the monitored settings and thresholds for each locomotive, and further based on fully independent mode limits, and rules for each locomotive. Thus, train operations may be optimized for each locomotive over the entire route to provide further performance benefits.

In this way, train operations may be planned by determining a first synchronous plan profile based on operator preferences, and operating conditions, and then automatically processing the first plan profile, in view of anticipated issues, to generate a second independent plan profile for at least one identified region wherein performance benefits may be attained by switching to the second profile. The second profile may be monitored for further real-time adjustments. The plurality of locomotives of the train may be operated based on the first and/or second profile to control movement of the train along the designated route. Alternatively train operations may be planned according to a third fully independent plan profile with fully independent settings for each locomotive over the entire route.

Although embodiments of the invention have been described herein in regards to locomotive and trains, any of the embodiments (or combinations or variations thereof) are more generally applicable to rail vehicle consists and other vehicle consists (a vehicle consist being a group of vehicles that are linked to travel together). Thus, any instances of "train" are more generally applicable to a rail vehicle consist or other vehicle consist, and any instances of "locomotive" are more generally applicable to powered vehicles, wherein "powered vehicle" refers to a vehicle with an on-board traction system for self-propulsion and braking.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims. Moreover, unless specifically stated otherwise, any use of the terms first, second, etc., do not denote any order or importance, but rather the terms first, second, etc. are used to distinguish one element from another.

The invention claimed is:

1. A method of controlling movement of a train consist including a plurality of locomotives along a route, comprising:

receiving input from one or more sensors of the train consist;

generating, at one or more of an off-board or an on-board controller, a fully independent plan profile for the train consist including fully independent settings for each of the plurality of locomotives of the given train consist over the route, the fully independent settings generated according to one or more cost functions and constraints based on the received input; and operating the train consist according to the generated fully independent plan profile, wherein the one or more cost functions and constraints are based on train operating parameters including a rate of change in node position, wherein generating the fully independent plan profile includes generating fully independent settings based on undulation parameters relative to one or more thresholds, wherein the one or more cost functions and constraints are further based on undulation parameters relative to one or more thresholds, the undulation parameters including one or more of a number of uphill regions of the train consist, a length of each uphill region, a grade of each uphill region, a number of downhill regions of the train consist, a length of each downhill region, and a grade of each downhill region, wherein generating fully independent settings includes generating fully independent settings based on one or more of the number of uphill regions of the train consist being greater than a threshold, the length of each uphill region being higher than a threshold percentage of a length of the train consist, the grade of each uphill region being greater than a threshold grade, the number of downhill regions of the train consist being greater than the threshold, the length of each downhill region being higher than the threshold percentage of the length of the train consist, and the grade of each downhill region being greater than the threshold grade.

2. The method of claim 1, wherein the one or more cost functions and constraints based on the received input further include coupler forces, and wherein the cost function coefficients for tensile coupler forces are penalized heavier than the cost function coefficients for compressive coupler forces.

3. The method of claim 1, wherein the one or more cost functions and constraints based on the received input further include one or more of train power, train speed, rate of change of power, tractive effort, rate of change of tractive effort, coupler force, and fuel use.

4. The method of claim 1, wherein the undulation parameters of the train consist are based on one or more terrain features, the terrain features including an undulation, a crest, and/or a sag estimated based on the received input.

5. The method of claim 3, wherein generating the fully independent plan profile includes adjusting a fully independent setting for a first locomotive of the train consist while maintaining a fully independent setting for a second locomotive of the train consist.

6. The method of claim 5, wherein the independent setting includes a notch setting for a locomotive throttle.

7. The method of claim 3, wherein generating the fully independent plan profile includes adjusting an independent setting for each of one or more locomotives of the train consist to maintain a train speed.

8. The method of claim 1, wherein the one or more sensors include a track sensor, a coupler force sensor, and a location sensor.

9. The method of claim 8, wherein the plurality of locomotives are coupled to each other through a coupler and wherein the coupler force sensor is connected to the coupler.

10. The method of claim 1, wherein the operating includes adjusting settings of one or more of a locomotive throttle and a locomotive brake.

11. The method of claim 7, wherein adjusting the independent setting for each of one or more locomotives of the train consist includes commanding a first notch setting for a lead locomotive while commanding a second, different notch setting for a remote locomotive.

12. The method of claim 1, wherein the fully independent plan profile is generated in segments as the train consist progresses along the route.

* * * * *